US005848510A

United States Patent [19]

Grazman et al.

[11] Patent Number: 5,848,510

[45] Date of Patent: Dec. 15, 1998

[54] BASE SHEET FOR ROOFING ASSEMBLY

[75] Inventors: Brent L. Grazman, Livingston; William J. Woodring, Bound Brook, both of N.J.

[73] Assignee: Building Materials Corporation of America, Wayne, N.J.

[21] Appl. No.: 794,824

[22] Filed: Feb. 4, 1997

[51] Int. Cl.[6] ..... E04B 5/00

[52] U.S. Cl. ..... 52/411; 52/408; 52/409; 52/445; 52/446; 52/746.11; 52/748.1

[58] Field of Search ..... 52/411, 412, 408, 52/409, 445, 446, 741.4, 740.1, 746.11, 747.11, 748.1, 90.2, 91.1

[56] References Cited

U.S. PATENT DOCUMENTS 3,135,069 6/1964 Schuller et al. ..... 52/411 X 5,253,461 10/1993 Janoski et al. ..... 52/411 X 5,367,849 11/1994 Bullock ..... 52/746.11 X

*Primary Examiner*—Creighton Smith

*Assistant Examiner*—W. Glenn Edwards

*Attorney, Agent, or Firm*—Marilyn J. Maue; William J. Davis

[57] ABSTRACT

An improved base sheet for a roofing assembly wherein the base sheet is perforated with a plurality of apertures characterized by non-cylindrical cutouts in the shape of a closed figure or a polygon having at least two sides or boundaries of unequal length which aperture configuration permits strong attachment of the sheet to a substrate without the aid of auxiliary attachment means and without weakening of the base sheet structure.

13 Claims, 3 Drawing Sheets

FIG I
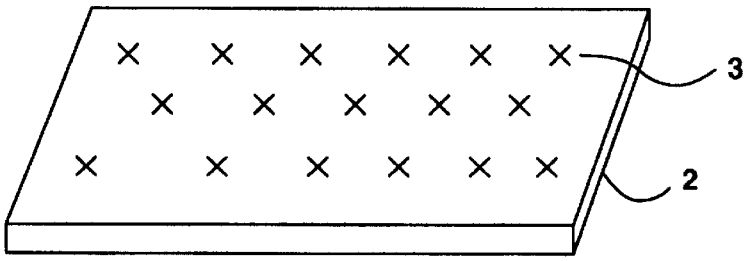
FIG. II
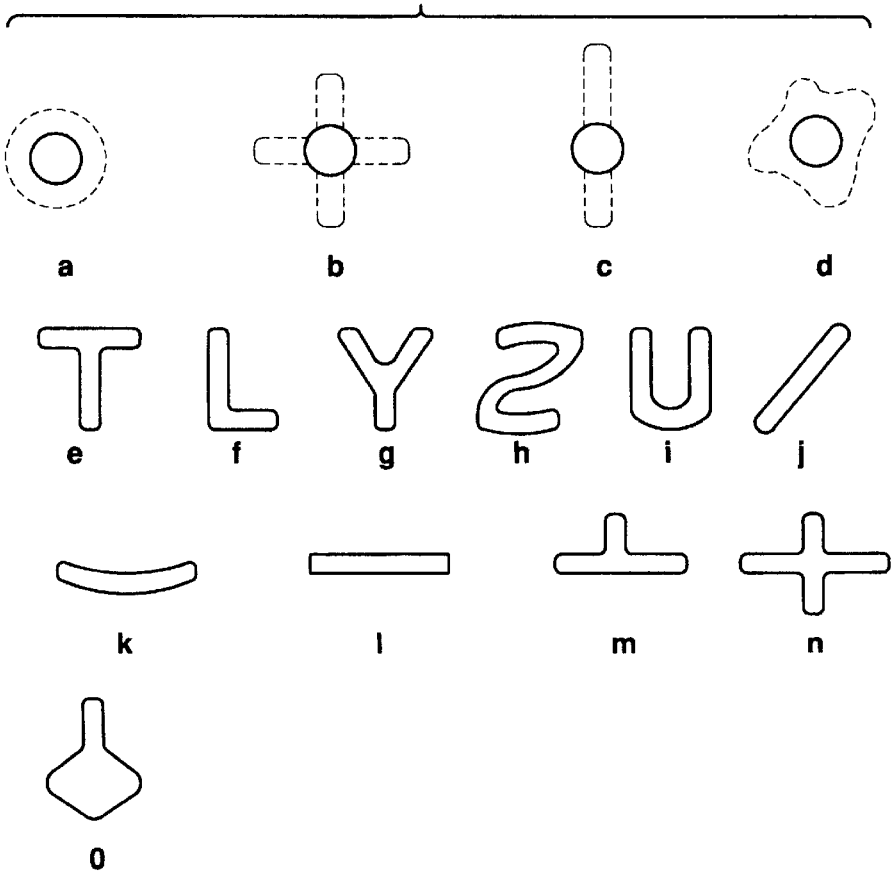
FIG. IV
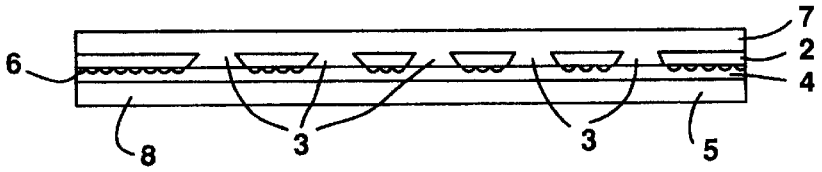

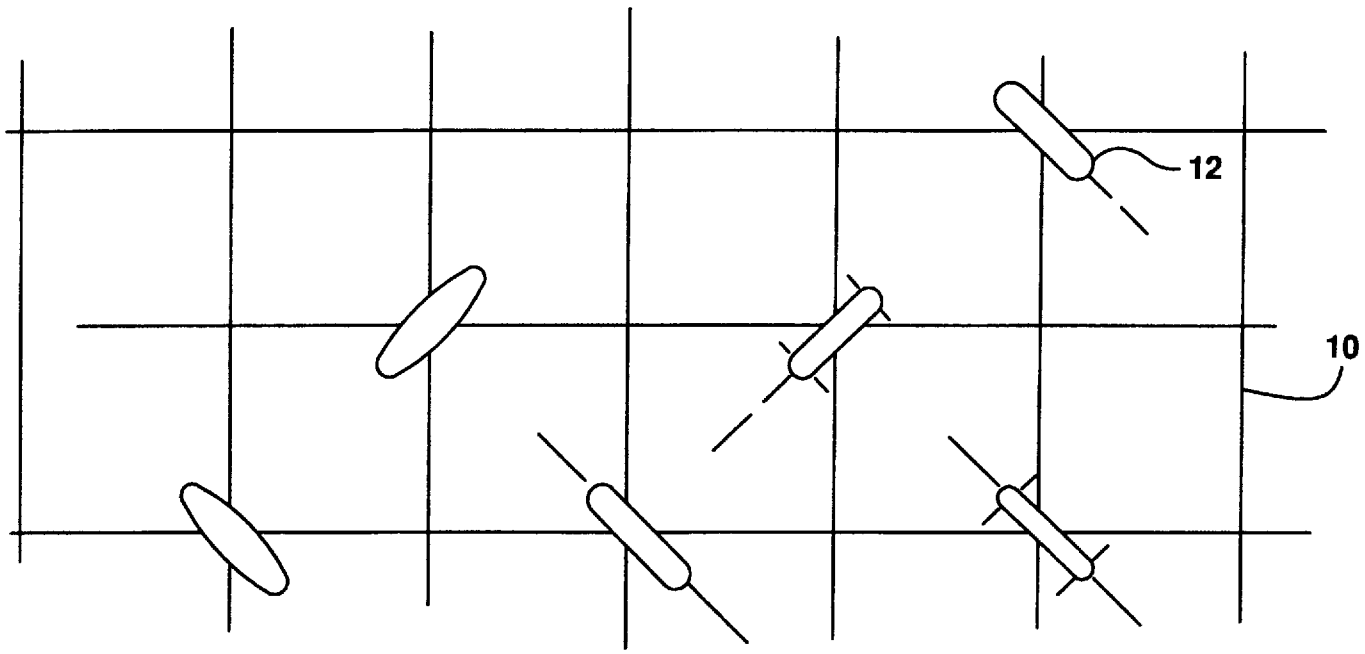
FIG. III

FIG. V
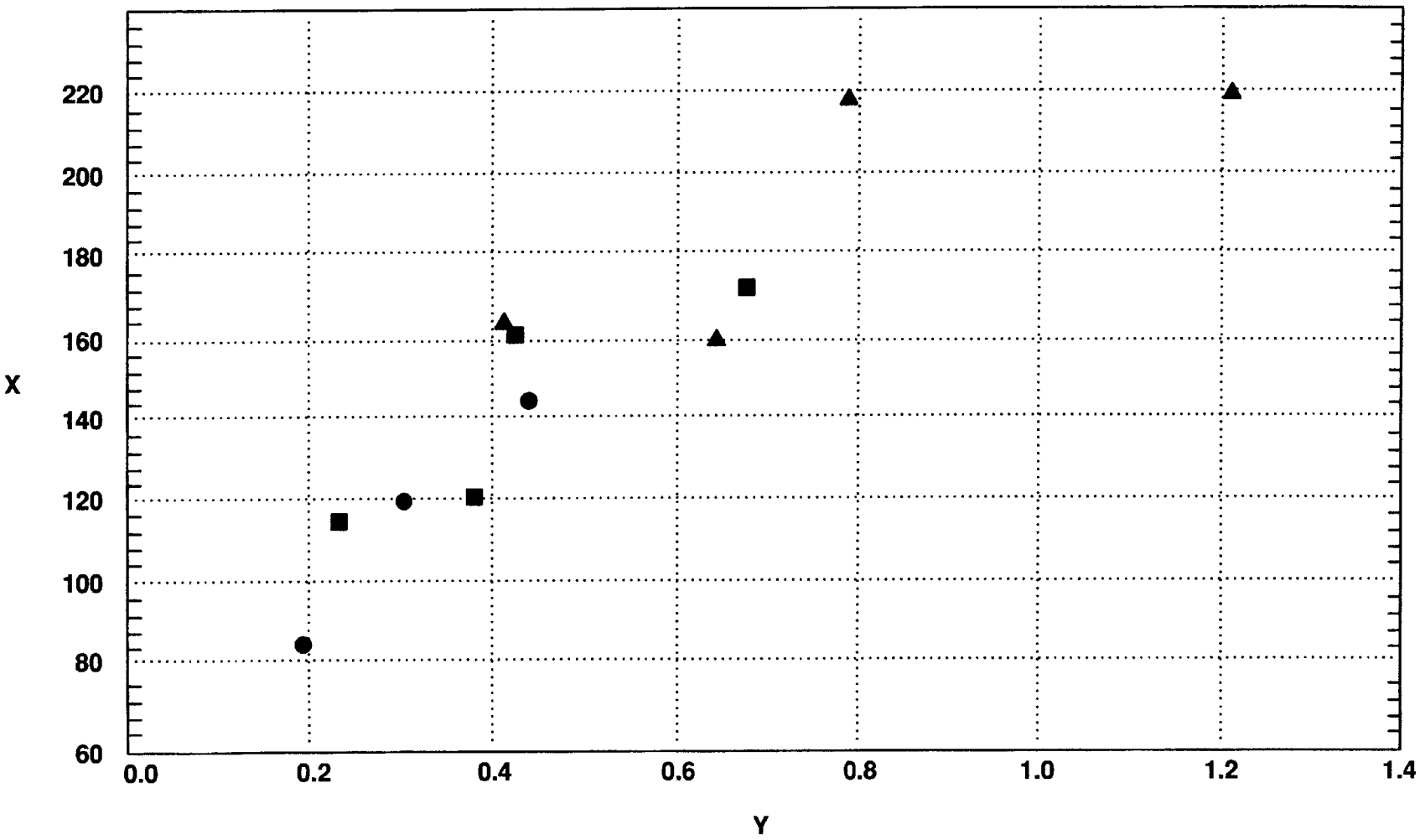

BASE SHEET FOR ROOFING ASSEMBLY

BACKGROUND OF THE INVENTION

A persistent problem associated with roofing assemblies is wind uplift resulting in separation of a base sheet from a substrate such as the roof deck or a deck surfaced with an insulation layer. In areas of relatively higher wind velocity, has been difficult to achieve the wind uplift resistance required by codes or building designers without using cost prohibitive construction techniques. In the case of nailable decks, it is often necessary to fasten the roof deck to the surfacing layers at short intervals thus increasing the time and expense of installation. On the other hand, several non-nailable decks have not been able to provide adequate resistance to wind uplift. Accordingly, several alternative methods, purported to avoid attachment failure have been suggested. Foremost is the use in the assembly of a uniformly perforated base sheet having circular perforations which permit flow of an adhesive through the apertures so as to adhere the sheet to the substrate. The adhesive can be applied by hot mopping over the perforated base sheet surface thus permitting follow-through and attachment of the sheet to the deck or an underlying insulation layer in the perforated area. While this method is cost and time saving in that it eliminates the need for securing devices at critical intervals, it has not been found effective in environments subject to relatively higher wind velocities since the base sheets currently available do not provide sufficient adhesive force and sheet integrity to resist strong wind uplift forces. In the case of a conventionally perforated base sheet, merely widening the circular perforations or increasing their number is not a viable solution since either approach decreases the strength of the sheet.

Accordingly, it is an object of this invention to provide a roof deck assembly which has superior resistance to wind uplift forces and other damage caused by weathering.

Another object of the invention is to provide a solution to the problem of increased base sheet adhesion without reducing the strength of the sheet.

Still another object of this invention is to provide a new and improved base sheet for roofing systems having high wind uplift resistance which is economical to produce and install.

Yet another object is to provide a base sheet having apertures altered to achieve greater adhesive follow-through per internal area of the aperture.

These and other objects and advantages will become apparent from the following description and disclosure.

THE INVENTION

In the roofing assembly of this invention, including a roof deck, optionally an insulation layer positioned over the deck and an upper apertured base sheet, the improvement which comprises a base sheet having modified apertures adapted to increase the strength of the bonding between the finished assembly and the deck or intervening insulation layer without diminishing the essential strength and integrity of the base sheet wherein the apertures are characterized as non-cylindrical cutouts in the shape of a closed figure or polygon having at least two sides or boundaries of unequal length.

For the purposes of this invention, the following terms are defined.

The aperture is a non cylindrical cutout in the shape of a closed figure or a polygon having at least two sides or boundaries of unequal length, e.g. an oval having a major and minor axis of unequal length and other shapes disclosed herein.

The substrate is the layer, sheet or deck immediately below the base sheet.

The base sheet is the sheet suitably apertured to permit attachment to the substrate.

The insulation is a rigid or semi-rigid material which retards heat flow.

The membrane is a waterproof layer of modified bitumen sheet, roofing felt, asphalt, adhesive, etc. The roofing assembly includes the base sheet and all layers or sheets above and below the base sheet. The auxiliary sheet or sheets include one or more layers of roofing felt, modified bitumen, insulation, a capping sheet, a traffic surfacing sheet and the like which are positioned above the base sheet.

In a base sheet, an aperture having a circular shape offers the smallest peripheral dimension for a given enclosed area; hence the least area of potential adhesive penetration into a substrate in the region surrounding the aperture site. It is now discovered that by lengthening the perimeter of the aperture relative to its enclosed area, and in fact by any deviation from the configuration of an equilateral, equiangular polygon, one is able to increase the net area of adhesive interaction between the sheet and the substrate and additionally to extend the area for adhesive penetration into the substrate in the region surrounding the extended perimeter of the aperture. This innovation achieves unexpectedly stronger attachment between the substrate and the overlying assembly without concomitant weakening of the base sheet structure normally associated with widening the perforations of the prior art. Thus, the fundamental principal of this invention is that the greater the deviation of instant apertures from a cylindrical shape or the shape of a circle, equilateral triangle or a square, the larger the potential attachment area and the greater the resistance to wind uplift. In the following disclosure it will become apparent that the degree of attachment strength varies directly with the perimeter of the present non-cylindrical apertures and that the resistance to wind uplift forces can be increased at least two fold over circular perforations of the prior art which circumscribe the same internal area.

Among the many aperture shapes and configurations contemplated for this invention, there is included ovate, lyrate, channel or slot, T-shape, I-shape, L-shape, Y-shape, star and bladder shapes as being particularly beneficial for increasing adhesion of the base sheet to an underlying substrate.

In general, the number of apertures in the base sheet of the present invention is about the same or somewhat less than that conventionally employed and the periphery of apertures herein disclosed is between about 3 and about 6 inches. Instant apertures have a length of from about ¼ to about 3 inches and a width at least ⅛th inch less than the length, e.g. a width of from about ⅛ to about ⅓ inch for ovate or slotted shapes. The preferred apertures of this invention are those having rounded edge portions such as for example apertures in the shapes of an oval, bladder, etc. The preferred non-cylindrical apertures of this invention can be defined by the formula:

$$R/R' => 2$$

where R is radius (a) of a circle circumscribed around a given aperture of the present invention and R' is radius (a') of a circle constructed to have the same internal area of said aperture.

The apertures are uniformly spaced on the base sheet and are usually inset from the marginal edges of the sheet by from about 1 to about 6 inches depending in part on the size of the sheet and the type of roofing assembly, e.g. the degree of flexibility, thickness etc. Suffice it to state that they are inset by a margin sufficient to provide good manufacturability and effective adhesion in the construction of the roofing assembly. The apertures are conveniently spaced one from the other by a distance effective to adhere the undersurface of the base sheet to the substrate, e.g. an aperture offset of from about 3 to about 7 inches depending on the size of the sheet commensurate with the shape and size of the aperture; although, when desired, the aperture spacing near the edges of the sheet can be significantly less than that employed in the central portion. Most often, uniform spacing throughout the sheet is preferred. Although any conventional pattern of aperture deployment can be used, it is found that a chevron pattern, an embodiment of which is illustrated in FIG. III of the drawings, provides excellent resistance to wind uplift as well as good manufacturability.

The apertured base sheet of the present invention can be laid over a conventional roof deck such as one composed of gypsum, cement, wood or metal such as steel in a vented or non-vented system. When desired, a rigid or semi-rigid thermal insulation board of 0.25 to 24 inch, preferably 0.5 to 10 inch, thickness containing Perlite, polyisocyanurate, polystyrene, polyurethane, fiber board, foam glass and combinations thereof, can be employed between the deck and the base sheet; although insulation can be omitted by option. Alternatively, the insulation layer can be applied in a protected membrane arrangement (e.g. IRMA®) above the base sheet.

The width of the base sheet is generally about 12, 24, 36, 40 (e.g. 1 meter) or 48 inches and the sheet is typically supplied in rolls. Although the thickness of the base sheet can vary from about 1 to about 5 mm; a thickness of from about 1.5 to about 3 mm is preferred. The base sheet is composed of an organic or inorganic material, saturated or coated with oxidized or non-oxidized asphalt, a polymer modified asphalt or coal tar, e.g. modified with a polyolefin, SBS, rubber and the like. The top and under surfaces of the present base sheet are coated with an asphaltic material and granules can be embedded in the under surface asphaltic layer. To prevent sticking between layers when shipped in rolls, the base sheet is usually contacted with a release agent, such as sand, talc or a soap. Also, the surface can be covered with a ventilating material, as in granule surfacing or it can be channeled to provide release of accumulated vapor after installation and during the life of the roofing assembly.

The apertures of the base sheet can be formed by cut outs in any of the shapes covered herein or they can be formed to include void areas in its undercoating below surface perforations.

The sheet can be subjected to surface hot mopping with an adhesive melt. Also the base sheet can be installed and simultaneously bonded to the substrate and other layers of the roofing assembly with adhesives described below. It is also within the scope of this invention to avoid hot mopping by the use of Ruberoid Modified Bitumen Adhesive or other solvent cutback asphaltic adhesive. A torching technique which fuses a torch grade roofing sheet to a substrate through the apertures can also be employed.

Conventional types of bonding agent can be employed for attaching the base sheet to the substrate; these include bitumen, such as asphalts and coal tar pitch having softening points of from about 100° F. to about 500° F. The bonding material can contain from 0 to about 75 wt. % mineral stabilizer, such as that derived from limestone, stone dust, sand or other fine or granulated mineral particles. Before application, the bonding agent is heated to a flowable condition. The base sheets can be laid as panels abutted in side-by-side or overlapping relationship prior to the hot mopping operation or they may be laid and mopped in a single operation, e.g. with a felt laying apparatus. As indicated above, it is also within the scope of this invention to avoid hot mopping in favor of a torching technique which fuses through the base sheet to the substrate.

The final roofing assembly includes layers above the base sheet which are conventionally employed in a roof assembly. These additional layers include saturated felt, polymer modified roofing materials, optionally an insulation membrane and other layers desired in the assembly. Generally, the roofing assembly is capped with a weather resistant surface layer.

Having generally described the present invention, reference is now had to the accompanying drawings which illustrate certain aspects and preferred embodiments but which are not to be construed as limiting to the scope of the invention as defined in the appended claims.

DESCRIPTION OF THE DRAWINGS

FIG. I is a perspective view of base sheet 2 uniformly apertured at sites 3 indicated by X.

FIG. II illustrates preferred shapes of apertures for base sheet 2 in which a through d represent apertures through the base sheet where the granulated undercoating of the sheet is absent in the areas indicated by dotted line. Apertures e through o indicate cutout configurations for the apertures in base sheet 2

FIG. III shows an alternate pattern of aperture deployment on a portion of base sheet 2 employing a chevron placement of slot like apertures. This embodiment employs a 3 inch grid and slots 12 of 2 inch length and 0.5 inch width having centers offset by about 4 inches. Of course it will be understood that other lengths and thicknesses as well as other cutout shapes can be employed for the purposes of this invention.

FIG. IV is a side plan view of an installed and attached base sheet of a roofing assembly 8 including roof deck 5, insulation board 4, base sheet 2 having granules 6 on its undersurface and adhesive layer 7 which permeates apertures 3 of sheet 2 and the surrounding surface areas of insulation layer 4. As indicated above the final assembly optionally includes one or more conventional insulation and/or weather resistant layers over adhesive layer 7; however, the novelty of this invention does not reside in such modifications except in combination with the present base sheet having altered aperture configurations.

FIG. V is a diagramatic comparison of base sheet/substrate attachments.

COMPARATIVE EXAMPLE A

A plurality of 24 by 24 inch non-perforated base sheets, composed of a fiberglass nonwoven core saturated with filled, oxidized asphalt were modified by having 3/16 inch wide by 2.5 inch long channels on the undersurface of each sheet at 4.5 inch offsets. The area of adhesive penetration through the non-perforated sheet was essentially zero. The internal area of each channel was approximately 0.47 square inches and the perimeter was approximately 5.4 inches. The base sheets were adhered to a sheet of ¾ inch thick plywood by applying a thin layer of BUR mopping asphalt at its equiviscous temperature over the plywood, laying the base sheets in abutment over the mopped asphalt. A similarly thin layer of viscous mopping asphalt was then applied over the base sheet surface and, while hot, another similar piece of plywood was laid over the top of the base sheet assembly. The final assembly was allowed to cool for 3 days, after which a force of 665 lbs/ft$^2$, applied in the direction normal to the plane of the sheets, was applied. The assembly failed at a force of 150 lbs/ft$^2$ which corresponds to 665 lbs/ft$^2$ after correction for the weight of the test apparatus.

COMPARATIVE EXAMPLE B

The assembly in Example A is repeated, except that the base sheets were perforated with conventional ⅝ inch circular holes on 3 inch centers, and was mopped to a substrate of 1⅛ inch thick polyisocyanurate board. The internal area for each aperture is about 0.3 square inches, and the perimeter of each was approximately 2 inches. After cooling, this assembly showed an uplift resistance of only about 665 pounds, which corrects to about 150 lbs/ft$^2$.

EXAMPLE C

The assembly in Example B is repeated, except that the perforations were modified to consist of two ⅝ inch wide grooves surrounding and directly communicating with the perforations; which grooves were scraped from undercoating of the base sheet. The apertures were identical to those in Example B, but the associated voids were approximately 0.5 square inches in area and 5.4 inches in perimeter. After cooling, this assembly showed an uplift resistance of over 965 pounds of force which corrects to over 225 lbs/ft$^2$.

EXAMPLE D

The assembly in Example B is repeated, except that the apertures consisted of ¼ inch wide by 3 inch long slots placed on 4.5 inch centers (chevron style). The internal area of these apertures was 0.8 inches and the perimeter was approximately 6.8 inches. After cooling, this assembly showed an uplift resistance of over 1000 lbs/ft$^2$ of force, which corrects to over 250 lbs/ft$^2$.

When T-shaped apertures on the base sheet are substituted for the slots in the base sheet of Example D, similar resistance to uplift is attained.

FIG. V of the drawings is a diagrammatic comparison of base sheet/substrate attachments generally described in Examples A through D above. In this figure, the wind uplift resistance in lbs/ft$^2$ is plotted along the X axis and the internal area of the aperture in inches is plotted along the Y axis. Further in this figure, the symbol ■ represents base sheet apertures of the configuration described in Example A; the symbol ● represents the conventional base sheet apertures described in Example B and the symbol ♦ represents the base sheet apertures described in Example D. As the curve illustrates, particularly in the internal area of 0.4–0.45, the configuration of the aperture has a significant affect on the resistance to wind uplift forces. The apertures having an internal area of less than 0.3 are simply to small to provide the desired adhesion between the base sheets and the substrates although the sheet itself retains good strength. An internal area of 0.45 is about the maximum tolerable for base sheet strength when circular apertures are employed; however in the case of ovate or T-shaped apertures, the strength of the base sheet was not noticeably diminished when larger apertures of greater internal areas were employed.

Substantially similar improvement is achieved with apertures of the other non-cylindrical configuration described herein.

What is claimed is:

1. In a roofing assembly including a base sheet adapted to be adhesively attached to a substrate and having an asphaltic undercoating in which granules are embedded and spaced apertures through the sheet and adapted to allow flow of adhesive through the apertures onto the substrate, the improvement which comprises: a base sheet having modified apertures adapted to increase the bonding strength between the base sheet and the substrate without diminishing the strength of the sheet, said modified apertures characterized as non-cylindrical cutouts in the shape of a closed figure or a polygon having at least two sides or boundaries of unequal length.

2. The assembly of claim 1 wherein an aperture of the base sheet includes a void area in its undercoating of larger dimension than said aperture which is directly below and in open communication with said aperture, thus providing a vertical aperture through said base sheet and permitting passage of an adhesive through the base sheet and said granular embedded undercoating onto the surface of the substrate.

3. The assembly of claim 2 wherein said vertical aperture is in the shape of a three dimensional figure selected from the group consisting of an hourglass, a star, a clover leaf and a bladder.

4. The assembly of claim 1 or 2 wherein the substrate is a roof deck.

5. The assembly of claim 1 or 2 wherein the substrate is an insulation layer.

6. The assembly of claim 1 wherein the substrate is a thermal insulation layer of rigid or semi-rigid fibrous, polymeric or glass foam material interposed between the base sheet and the roof deck.

7. The assembly of claim 1 or 2 wherein the aperture is defined by the formula $$R/R' => 2$$

wherein R is radius (a) of a circle circumscribed around a given aperture of claim 1 and R' is radius (a') of a circle constructed to have the same internal area as that of said given aperture.

8. The assembly of claim 1 wherein the apertures of the base sheet are uniformly spaced.

9. The assembly of claim 8 wherein the apertures of the base sheet are deployed in a chevron pattern.

10. The assembly of claim 2 wherein the voided areas are channels radiating from a circular aperture to provide a continuous star shaped aperture.

11. The assembly of claim 2 wherein the voided areas are enlarged circular areas around circular apertures to provide a continuous bladder shaped aperture.

12. The assembly of claim 1 wherein the apertures are non-circular and penetrate the base sheet and granule surfaced undercoating.

13. The assembly of claim 12 wherein the apertures are slot shaped.

* * * * *